US005941091A

United States Patent [19]

Broadbent

[11] Patent Number: 5,941,091

[45] Date of Patent: Aug. 24, 1999

[54] LOW COST ICE MAKING EVAPORATOR

[76] Inventor: John A. Broadbent, 5558 S. Yampa St., Aurora, Colo.

[21] Appl. No.: 09/006,816

[22] Filed: Jan. 14, 1998

[51] Int. Cl.[6] ..... F25C 1/12

[52] U.S. Cl. ..... 62/347; 62/515; 165/135; 165/170

[58] Field of Search ..... 62/347, 348, 352, 62/515; 165/135, 170

[56] References Cited

U.S. PATENT DOCUMENTS

| | | | |
|---|---|---|---|
| 3,206,944 | 9/1965 | Gallo | 62/347 |
| 4,412,429 | 11/1983 | Kohl | 62/347 |
| 4,458,503 | 7/1984 | Nelson | 62/347 |
| 4,589,261 | 5/1986 | Ohashi et al. | 62/347 |
| 4,590,774 | 5/1986 | Povajnuk | 62/347 |
| 4,903,504 | 2/1990 | Nelson | 62/347 |
| 4,995,245 | 2/1991 | Chang | 62/347 |
| 5,182,925 | 2/1993 | Alvarez et al. | 62/347 |

*Primary Examiner*—William E. Tapolcai
*Attorney, Agent, or Firm*—Gibson, Dunn & Crutcher LLP

[57] ABSTRACT

An ice cube making evaporator design comprising an aluminum roll-bond evaporator plate (50) which is encased in a plastic grid (59) of vertical and horizontal ridges, thereby forming an array of freezing sites (28) on both sides of the plate. Integral refrigerant passes (52) in the evaporator plate may be designed to be flat on one side, enabling the freezing sites (28) to be in direct contact with the refrigerant passes (52). Adjacent refrigerant passes (52) are flat on opposite sides of the evaporator plate (50') thereby enabling significant improvements in heat transfer geometry and performance. Boundary layer interrupters (68) and conductive anchors (86) are also disclosed for the purpose of heat transfer enhancement.

52 Claims, 14 Drawing Sheets

LOW COST ICE MAKING EVAPORATOR

TECHNICAL FIELD

This invention pertains to the field of ice cube making machines, and in particular to a low cost, high performance ice making evaporator design.

BACKGROUND OF THE INVENTION AND PRIOR ART

Ice machines are widely used in restaurants and the like for producing ice, in the form of flakes, chips, cubes, etc. for use in beverages and for other uses relating to food and drink services. Generally, these ice machines include a refrigeration apparatus for freezing water supplied to the machine, a means for periodically removing, or "harvesting" ice from the freezing surface, and a cabinet or bin for storing the ice until it is needed.

In a typical ice making apparatus, water is brought in contact with a refrigerated surface, usually referred to as the evaporator, to be frozen. Freezing takes place for an interval of time, typically fifteen to twenty minutes, until the size of the ice cube is adequate. At this point, the harvesting operation takes place to remove the cubes from the evaporator. When harvested, the ice cubes typically fall off of the evaporator and are directed into an ice holding bin.

Ice making evaporators are typically constructed using stainless steel or nickel-plated copper. These materials are used because of their suitability for use with potable water and their heat transfer characteristics. Copper for example, is an excellent conductor of heat and therefore is well suited for use in ice machines. Stainless steel is also used extensively in ice making evaporators because of its non-rusting properties and suitability for contact with potable water. While these materials are well suited for use in ice machine evaporators, they can be expensive to use and fabricate.

An example of an ice making evaporator that is commercially available is provided in U.S. Pat. No. 4,458,503 to Kenneth L. Nelson. This patent describes an ice making evaporator consisting of a serpentine copper tube to which a series of formed, nickel-plated copper strips are attached. The entire assembly is placed into an injection mold and molded over with a plastic material. All of the copper tubing and portions of the copper strips are molded over with plastic. Other portions of the copper strips are left bare (free of plastic) to provide a good heat transfer path from the refrigerant to the water and ice. These bare portions of the evaporator plate provide the locations where the ice cubes will form.

Another example of a commercially available ice making evaporator is provided in U.S. Pat. No. 5,479,707 to Alvarez, et al. This patent describes an evaporator constructed from sheets of stainless steel which are stamped, punched and then welded together to create a flat-walled serpentine refrigerant passage. This stainless steel serpentine is placed into an injection mold and molded over with a plastic material to create ice cube formation sites of the desired shape. The stainless steel is left exposed in the locations where ice is to form so as to improve heat transfer. In this design the ice cubes form on these exposed areas, which are also the stainless steel walls of the refrigerant passage.

Both of the evaporator designs referenced above utilize relatively expensive tooling, processes and materials to create the evaporator assemblies.

A primary objective of this invention is to utilize materials and manufacturing processes which are inherently low in cost in order to substantially reduce the cost of an ice making evaporator.

Another primary objective of this invention is to optimize the heat transfer performance of the evaporator assembly through its ice forming geometry and by incorporating unique features to enhance heat transfer.

Another primary objective of this invention is to minimize the thermal mass of the evaporator assembly. Since an ice machine evaporator is constantly cycled between hot and cold temperatures, lowering the thermal mass of the assembly will result in less energy being needed to heat and cool the assembly between those temperatures.

Another primary objective of this invention is to provide a freezing surface which meets the ice machine sanitation requirements of the National Sanitation Foundation.

The present invention achieves these objectives utilizing a uniquely formed aluminum roll-bond type evaporator plate upon which is molded a grid of plastic ridges which form an array of ice cube forming sites on both sides of the plate. This plastic grid is comprised of thin vertical ridges and wider horizontal ridges. The vertical ridges act to separate horizontally-adjacent cube forming locations. The horizontal ridges act to separate vertically-adjacent cube forming locations and to cover the refrigerant passages of the roll-bond evaporator plate. Additional features not previously used in ice making evaporators or roll-bond evaporator plates are also incorporated into the present invention to improve heat transfer and make this configuration manufacturable.

The low cost of the aluminum evaporator plate, the low thermal mass of the assembly, the geometry of the ice cube forming locations and the additional heat transfer improvements incorporated in this design provide superior heat transfer performance and significantly lower cost than existing ice making evaporator designs.

SUMMARY OF THE INVENTION

The invention herein comprises an ice making evaporator which can be inexpensively assembled with a novel combination of components manufactured with mature and relatively inexpensive manufacturing technologies. Harvesting ice from this evaporator is done using the traditional hot gas method, and requires no additional valves, piping, controls or moving parts.

As used herein, the term "cube" shall not be limited to describing a regular solid piece of ice with six sides, but includes solid pieces of ice of any suitable shape.

In the preferred embodiment, an aluminum roll-bond type evaporator plate serves as the core of the evaporator assembly. This type of evaporator is light-weight, low cost and has a low thermal mass (thermal mass being equal to the weight of the materials used multiplied by their specific heat). It is of a type commonly found in domestic, household refrigerators. This type of evaporator is basically a flat sheet of aluminum having an integrally-formed serpentine refrigerant passage running through it. In the preferred embodiment, each horizontal pass of the serpentine is formed so that it is flat on one side (that is, flush with the flat aluminum plate on one side). The side on which the pass is flat alternates each pass. As will be explained hereinbelow, this novel configuration greatly enhances the heat transfer performance of each freezing site.

To complete the evaporator assembly, the aluminum evaporator plate is placed into an injection mold so that the desired grid of plastic ridges can be molded onto it. During the injection molding process, hydraulic pressure is applied to the inside (the serpentine passageway) of the evaporator plate. This pressure counteracts the high external pressure exerted by the flowing plastic and prevents the serpentine passageway from being crushed. Certain areas of the injection mold contact the evaporator plate during molding, leaving the contacted areas of the evaporator free of plastic. These are the areas which will become the ice cube forming sites.

In addition to the novel configuration of the refrigerant passages and the plastic grid, there are also two features which further improve the performance of the evaporator. One is an interruption in the smooth contour of the plastic just above each freezing site. This interruption or bump causes the thermal and hydrodynamic boundary layer forming in the flowing stream of water to restart at the top of each freezing site. During the portion of the ice making cycle when the evaporator is just cooling the water (prior to ice formation), it is possible to increase the rate of heat transfer by restarting the boundary layer. This restart reduces the thickness of the boundary layer and thereby increases the local heat transfer coefficient.

Another feature added to the evaporator has to do with the method of attachment of the plastic grid to the aluminum evaporator plate. One way to achieve plastic adhesion is to put holes in the evaporator plate prior to molding. This allows the plastic on one side of the plate to attach itself, through the holes, to the plastic on the other side of the plate—thus locking the plastic on both sides to the plate. However the preferred method in the present invention is to place conductive anchors through the plate prior to molding. These anchors would extend out on either side of the plate and would be molded into the ridges of the plastic grid so as to retain the plastic to the aluminum. These anchors would also promote heat transfer from the aluminum evaporator plate into the plastic ridges to improve both the freezing and harvesting performance of the evaporator assembly.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
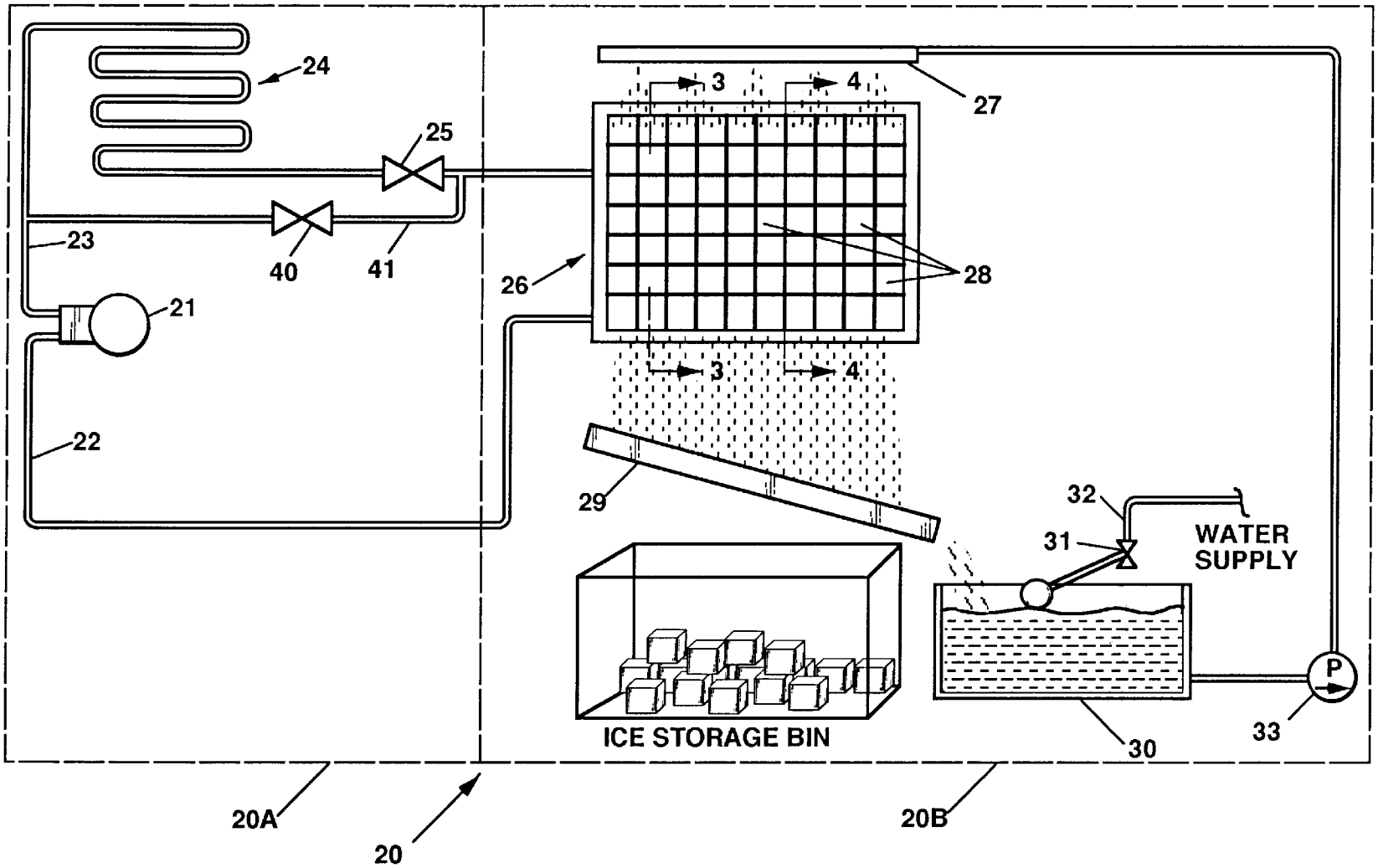
FIG. 1 is a schematic diagram illustrating the refrigeration circuit and the water supply circuit of the present invention.

Referring now to the Drawings, wherein like reference numerals designate like or corresponding parts throughout the views, and particularly referring to FIG. 1, there is illustrated a schematic diagram of a refrigeration circuit 20 incorporating the invention. The refrigeration circuit 20 is divided into two segments 20A and 20B.

The segment 20A comprises that portion of the refrigeration circuit 20 which contains certain conventional elements. These elements include a compressor 21 having a suction line 22 and a discharge line 23. In the discharge line 23 there is a condenser 24 for condensing the compressed refrigerant vapor coming from the compressor 21, and an expansion valve 25 for flashing a portion of pressurized liquid refrigerant into a vapor thereby lowering the temperature and pressure of the remaining un-vaporized refrigerant. Also shown is a hot gas valve 40 and a hot gas line 41 for supplying the evaporator with hot, high-pressure refrigerant gas directly from the compressor during the harvest portion of the ice making cycle.

The segment 20B comprises that portion of the refrigeration circuit 20 incorporating the present invention. To complete the refrigerant circuit 20, an evaporator assembly 26 is connected between the discharge line 23 and the suction line 22. The details of evaporator assembly 26 comprise the present invention, as will be described hereinbelow.

Gaseous refrigerant is compressed, condensed to a liquid and then expanded, in the form of a liquid spray into the evaporator assembly 26. Heat transferred into the liquid refrigerant causes it to evaporate. The evaporated refrigerant passes through suction line 22 back to the compressor 21.

FIG. 1 also illustrates the water supply circuit used to provide water to the evaporator assembly 26 for making ice. A water supply manifold 27 distributes a continuous stream of water across the front and rear surfaces of the evaporator assembly 26. The water which is not frozen at the freezing sites 28 while crossing the evaporator is collected below in a collection trough 29. The water then flows back into a tank or reservoir 30. A constant level of water is maintained in the reservoir 30 by means of a float valve 31 which regulates flow from the water supply 32. A pump 33 circulates water from the reservoir 30 to the water supply manifold 27.

Figure 2:
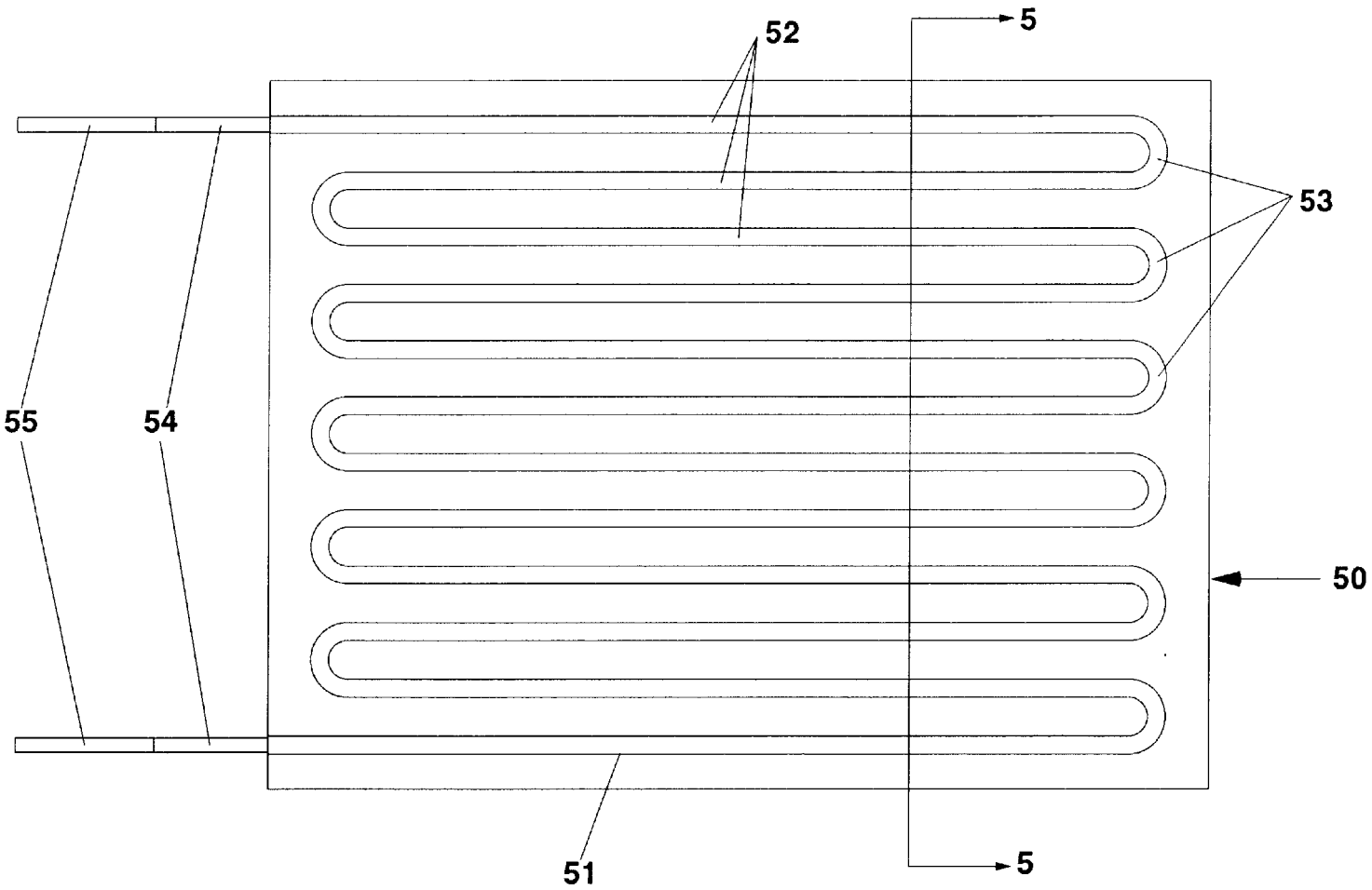
FIG. 2 is a plan view the aluminum roll-bond evaporator plate.

FIG. 2 is a plan view of the aluminum roll-bond evaporator plate 50 which is a component in the evaporator assembly 26 of FIG. 1. The evaporator plate 50 is of a type produced by Algoods, Inc. (Toronto, Ontario, Canada) and consists of a flat sheet of aluminum within which exists an integral serpentine refrigerant passage 51. Conceiveably, other materials could also be used to construct the evaporator plate 50 such as aluminum alloys, copper or other suitably conductive metals.

A roll-bond evaporator (such as evaporator plate 50) is fabricated by rolling together two sheets of aluminum, applying heat and pressure during the rolling process such that the two sheets are effectively welded together into a single sheet. By applying a special coating (sometimes referred to as "weld stop") between the sheets prior to the rolling/welding operation, it is possible to prevent the two sheets from welding together in the areas where the coating is applied. Thus by applying the coating in a serpentine pattern, it is possible to create a serpentine-shaped unwelded region within this welded part. By subsequently applying hydraulic pressure to this unwelded region, it is possible to inflate the unwelded serpentine region to form a serpentine passage through the plate. Thus a plate with an integral serpentine passage can be created in a very cost-effective manner. This type of evaporator is commonly used in domestic refrigerator applications where low cost is of extreme importance.

For use in ice making applications, the surface of evaporator plate 50 should be anodized or otherwise coated with a material judged suitable for food contact by the National Sanitation Foundation.

As shown in FIG. 2, the evaporator plate 50 has a single serpentine refrigerant passage 51. This serpentine refrigerant passage 51 consist of twelve straight sections or passes 52 and U-shaped bends 53. Except for the serpentine refrigerant passage 51, the evaporator plate 50 is primarily flat. At one end of the evaporator plate 50 are tube stubs 54 and 55 used to connect the refrigerant passage 51 to the refrigeration circuit of the ice machine. In the preferred embodiment, tube stubs 54 are aluminum so that they can be conveniently bonded to the evaporator plate 50. Tube stubs 55 are copper to allow convenient connection to the other refrigerant conduits in the ice machine, which are typically copper. The joint between tube stubs 54 and stubs 55 must be coated or covered with an electrically insulating material in order to prevent galvanic corrosion from occurring.

Figure 3:
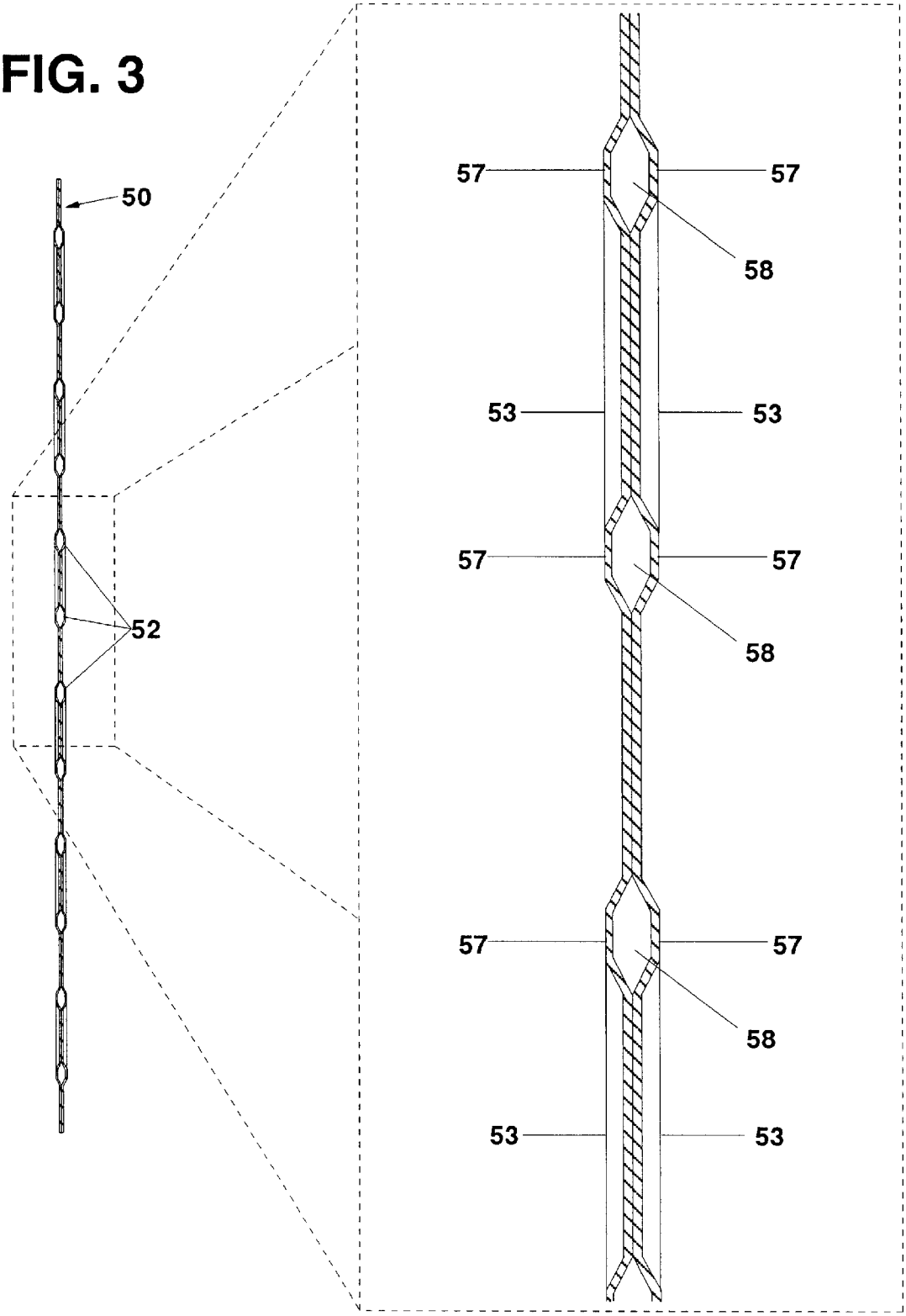
FIG. 3 is a cross-sectional view of one embodiment of the aluminum roll-bond evaporator plate taken along line 5—5 of FIG. 2.

FIG. 3 is a cross-sectional view of one embodiment of evaporator plate 50 taken along line 5—5 of FIG. 2. In this embodiment, the refrigerant passes 52 have been inflated during the manufacturing process such that the walls 57 of passes 52 protrude out equally on either side of the evaporator plate 50. It can also be seen in FIG. 3 that the walls 57 of refrigerant passes 52 are "flat-topped," rather than being round. This is due to the fixture used while inflating the passes 52 which limits the amount of tube expansion. Also illustrated in FIG. 3 are the hollow portions 58 of the refrigerant passes 52 through which the refrigerant flows, and the U-shaped bends 53.

Figure 4:
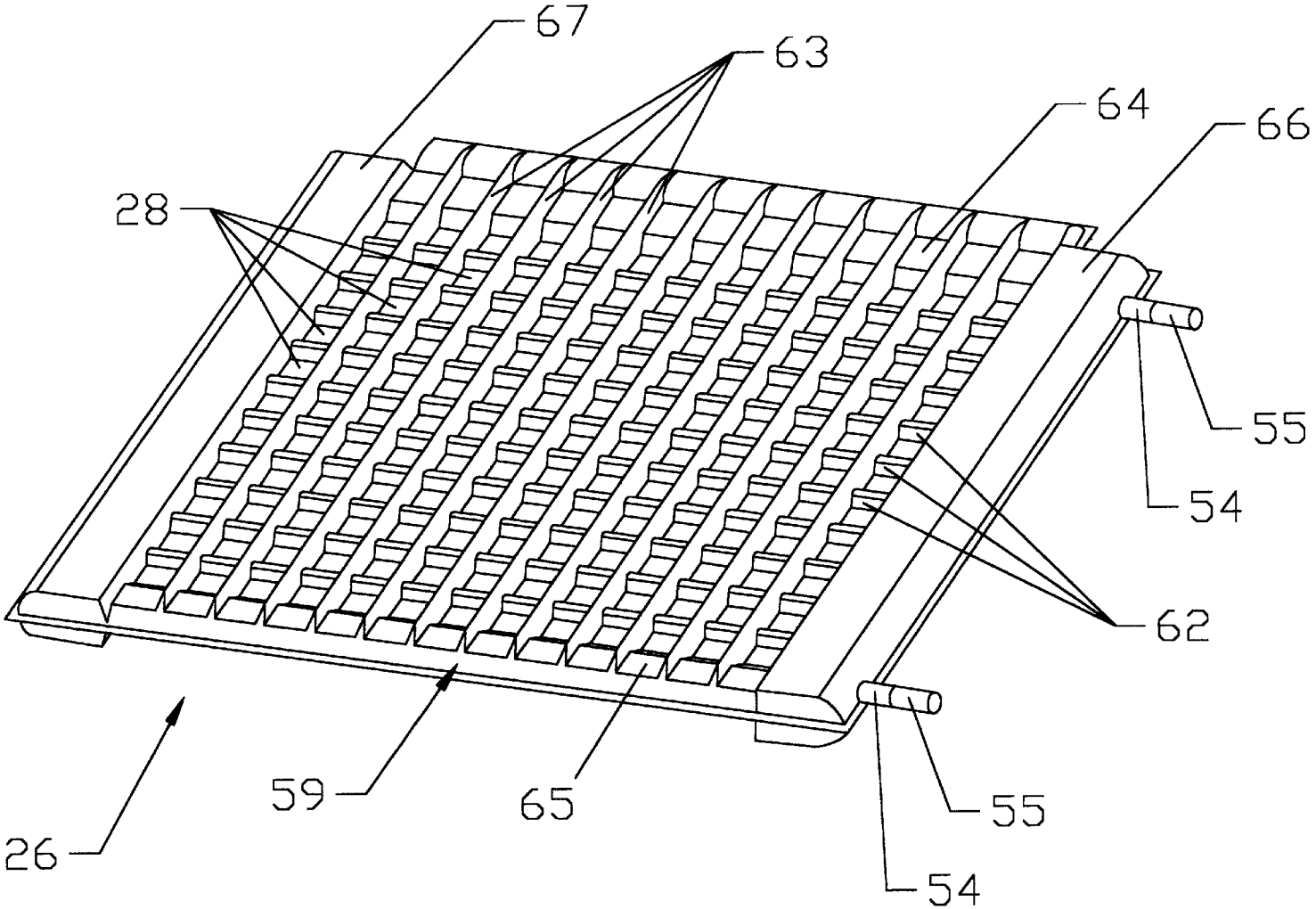
FIG. 4 is an isometric view of the evaporator assembly.

FIG. 4 is an isometric view of the evaporator assembly 26. The evaporator assembly 26 is comprised of a roll-bond aluminum evaporator plate 50 which has been molded over with plastic grid 59 of horizontal ridges 62 and vertical ridges 63 that protrude out from the plate such that an array of rectangular freezing sites 28 have been created on either side of the evaporator plate 50. The freezing sites 28 are defined by horizontal ridges 62 and vertical ridges 63. Both the horizontal ridges 62 and the vertical ridges 63 consist of plastic material molded onto the evaporator plate 50 during the injection molding process. The purpose of the vertical ridges 63 is to define the freezing sites 28 so that horizontally-adjacent ice cubes do not freeze together. The purpose of the horizontal ridges 62 is to define freezing sites 28 so that vertically-adjacent ice cubes do not freeze together. The horizontal ridges 62 are also designed to completely cover or straddle the straight refrigerant passes 52, as will be explained in detail herein below. Because the horizontal ridges 62 are designed to straddle the refrigerant passes 52, they are substantially wider than the vertical ridges 63.

It should be noted that except for the freezing sites 28, the entire exterior of the evaporator assembly 26 consists of plastic molded onto evaporator plate 50 during the injection molding process. The freezing sites 28 are left free of plastic to maximize conduction of heat from the aluminum evaporator plate to the water and ice.

Also shown in FIG. 4 are top and bottom insulating sections of plastic 64 and 65, respectively. These thicker plastic sections prevent ice from forming above or below, respectively, the array of freezing sites 28. There are also end-insulating sections 66 and 67 which prevent ice from forming on either side of the array of freezing sites 28. These end-insulating sections 66 and 67 also cover the U-shaped bend sections 53 of the refrigerant passage 51 on the evaporator plate 50. Tube stubs 54 and 55 can also be seen exiting the evaporator assembly through the end-insulating section 66.

Figure 5:
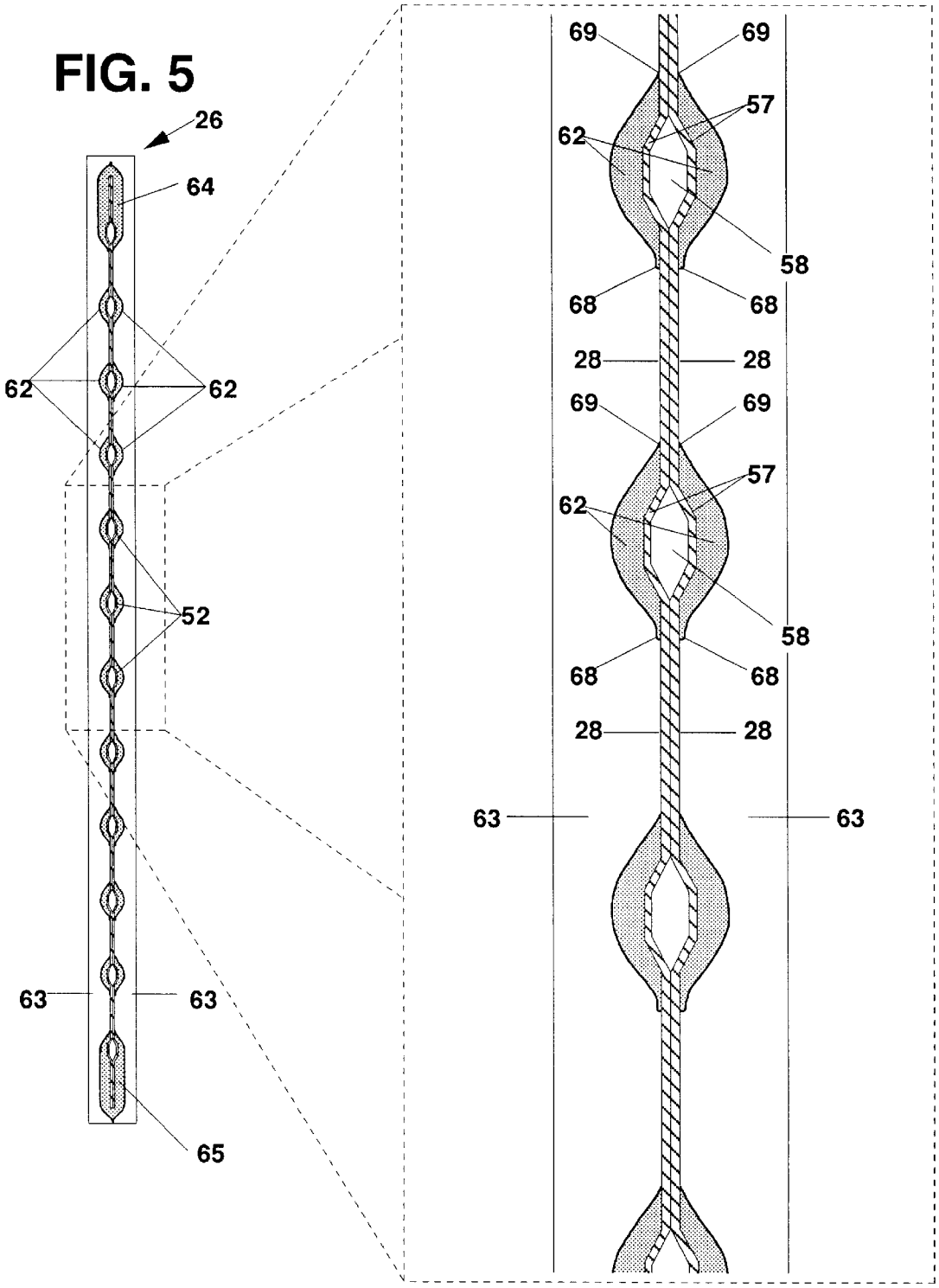
FIG. 5 is a cross-sectional view of one embodiment of the evaporator assembly taken along line 3—3 of FIG. 1.

FIG. 5 is a cross-sectional view of one embodiment of the evaporator assembly 26 taken along line 3—3 of FIG. 1. FIG. 5 shows that the horizontal ridges 62 of plastic serve to define vertically the freezing sites 28. It also shows that the horizontal ridges 62 completely cover or straddle the refrigerant passes 52. The reason for situating the horizontal ridges 62 over the passes 52 has to do with the manufacturing tolerances associated with the aluminum roll-bond evaporator plate 50, as will be explained below.

It would be desirable to leave the refrigerant passes 52 free of plastic so that they would be part of the freezing site and ice could form directly on them. This configuration would provide the best heat transfer path between the refrigerant and the water and ice. However, to accomplish this, it would be necessary to have the injection molding die contact the walls 57 of the refrigerant passes 52 tightly enough so that no plastic would flow between the injection molding die and the walls 57 during the injection molding. The injection molding die would have to almost exactly conform to the contour of the walls 57 leaving a gap of no more that a few thousandths of an inch. If the gap exceeded this amount, plastic would leak into the gap during injection molding, leaving undesired pieces of plastic on the evaporator assembly 26.

Unfortunately, the exact size, shape and location of the walls 57 of the refrigerant passes 52 on the roll-bond evaporator plate 50 cannot be manufactured to that close of a tolerance. So, instead of trying to have the injection molding die closely conform to the walls 57, the horizontal ridges 62 are designed to straddle the walls 57. The horizontal ridges 62 thus accommodate the variations in the height, width and location of the refrigerant pass walls 57 that result from the roll-bond manufacturing tolerances.

Also visible in FIG. 5 is the bump or interruption 68 in the smooth surface of the horizontal ridges 62. This bump 68 occurs at the bottom of each ridge 62 just upstream of the freezing sites 28. This bump 68 is in contrast to the smooth transition 69 from aluminum to plastic at the top of each ridge 62.

As water flows down the evaporator assembly 26, the flowing water generates a hydrodynamic and thermal boundary layer adjacent to the evaporator surface. The farther the water flows down the evaporator, the thicker this boundary layer becomes. The heat transfer coefficient between the water and the surface of the evaporator is a function of the thickness of this boundary layer—the thicker the boundary layer, the lower the heat transfer coefficient. However, it is possible to interrupt or trip this boundary layer causing it to become thin again, and thus improving the heat transfer coefficient. The thinnest boundary layer and best heat transfer will occur immediately downstream of the interruption used to trip or restart the boundary layer. The purpose of the abrupt bump 68 in the horizontal ridges 62 is to cause the boundary layer to restart just upstream of the freezing sites 28. Tripping or restarting the boundary layer at this point minimizes the boundary layer thickness and thus increases the heat transfer between the freezing site 28 and the water flowing over it, and thus improves the overall performance of the evaporator. A similar effect can be accomplished with other types of bumps or irregularities located on the horizontal ridges 62, with such bumps or irregularities having a dimension in the water flow direction of between 1/16 and 1/8 of an inch. Such bumps or irregularities should be designed so they do not interfere with the ability of ice cubes to be harvested from the surface of the evaporator assembly 26. The smooth transition 69 from the freezing site 28 to the horizontal ridge 62 at the bottom of the freezing site is necessary to ensure that the ice can slide off of the freezing sites 28 during harvest.

Figure 6:
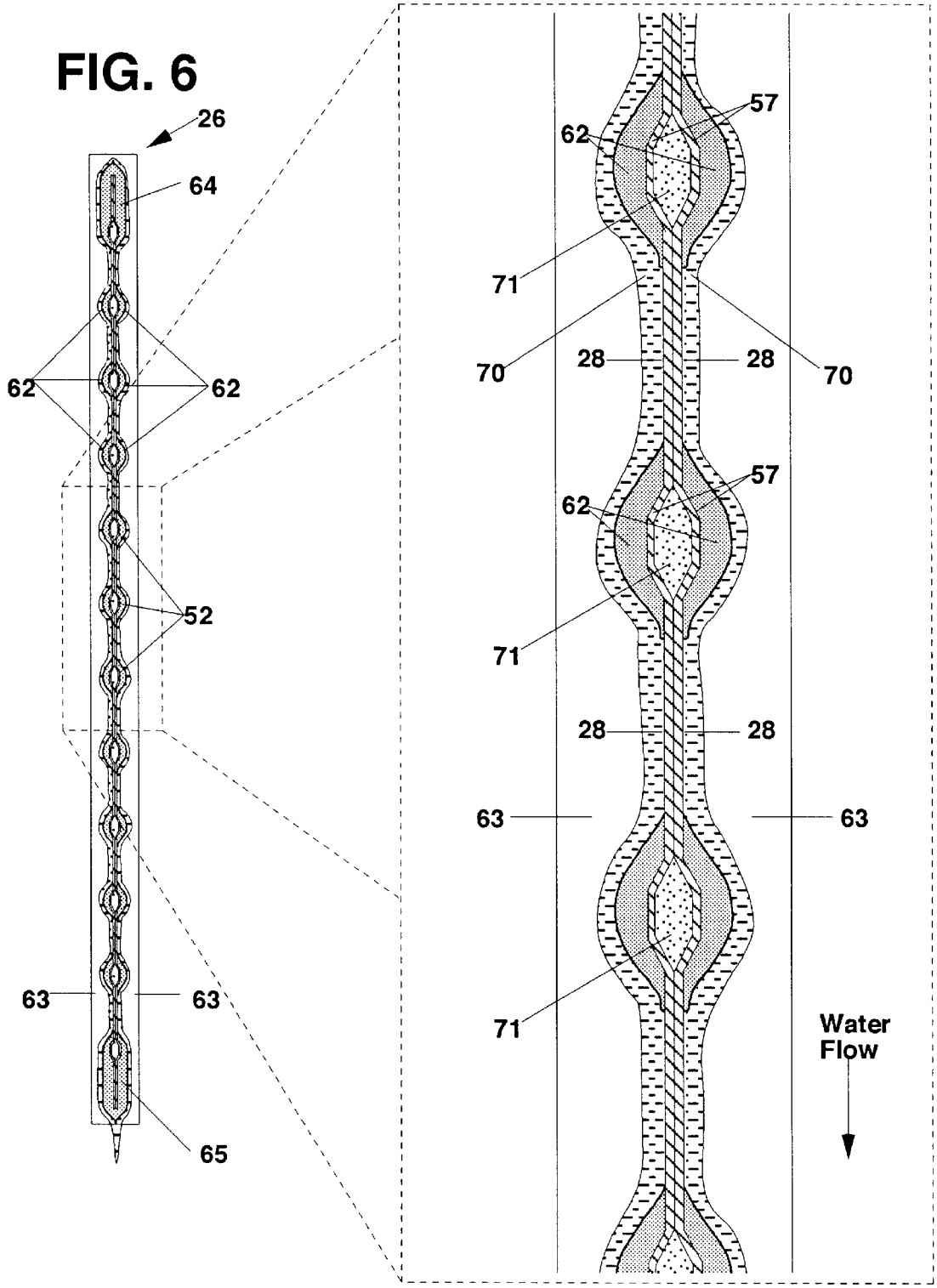
FIG. 6 through FIG. 8 are cross-sectional views, taken along the line 3—3 of FIG. 1, illustrating the sequence of operation of one embodiment of the evaporator assembly.
Figure 7:
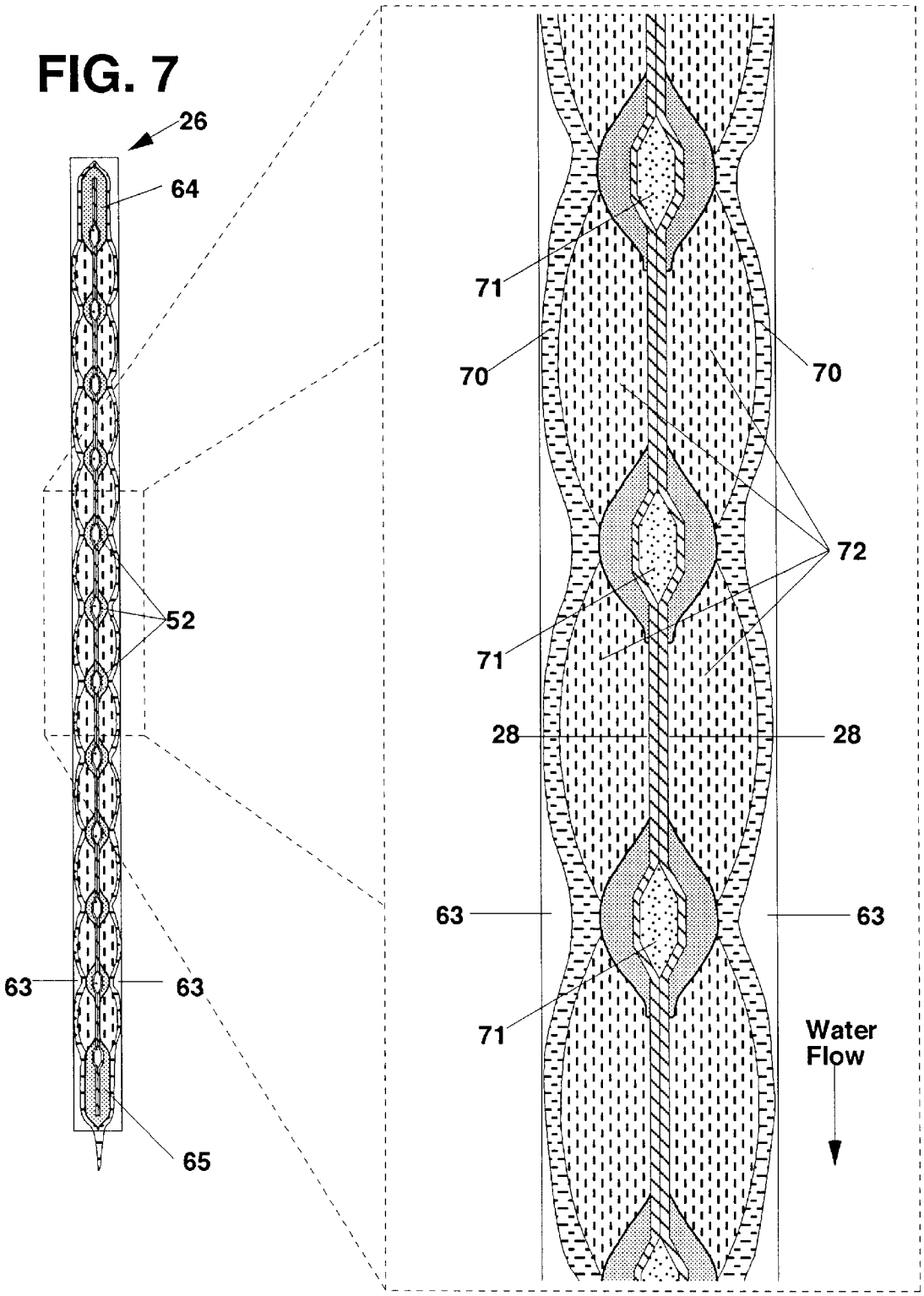
Figure 8:
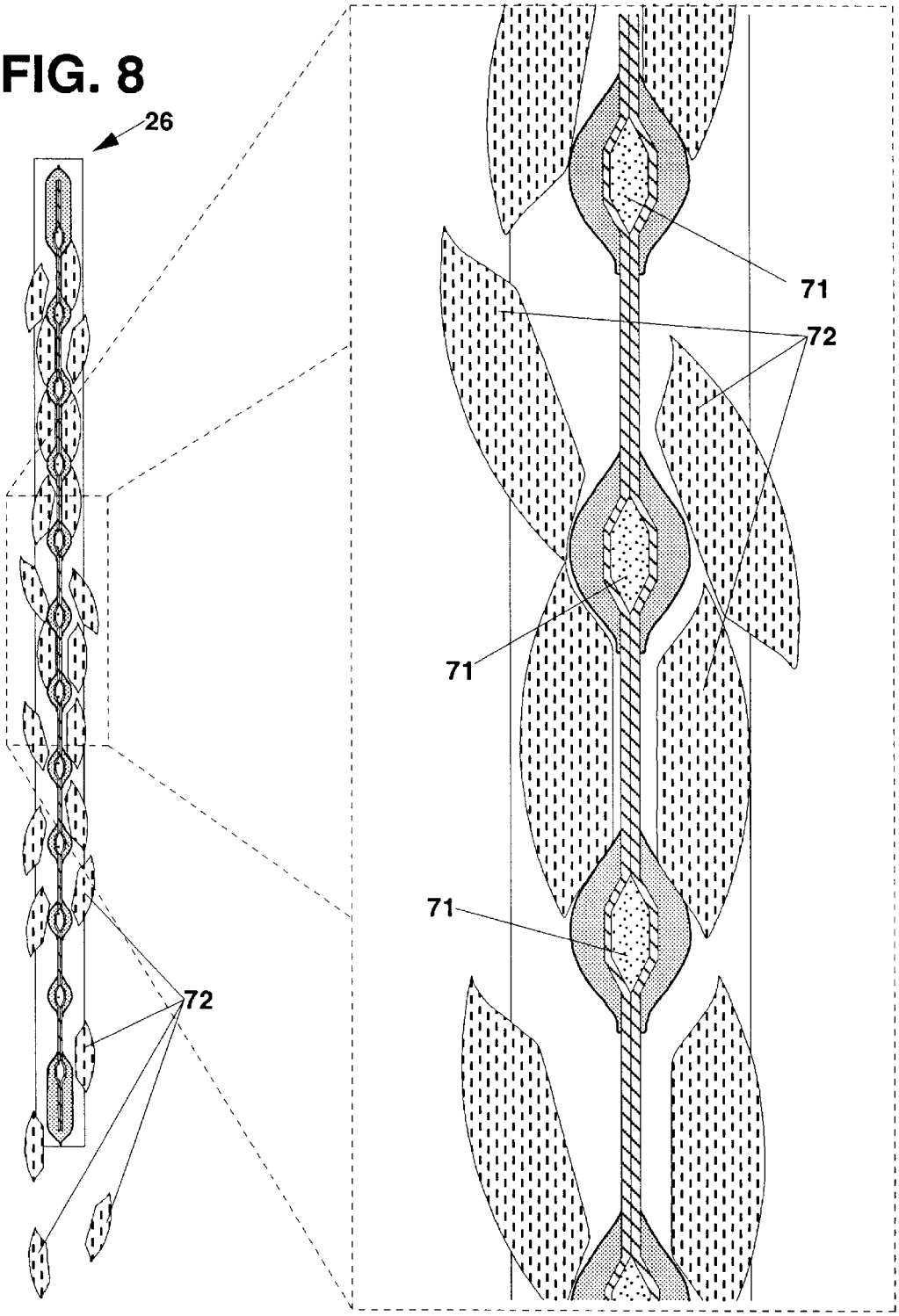

FIGS. 6, 7 and 8 are cross-sectional views of the evaporator assembly 26 taken along line 3—3 of FIG. 1, and illustrate the sequence of operation of the evaporator assembly 26. FIG. 6 shows the evaporator assembly 26 with water 70 flowing vertically down over it. This would occur during the portion of the ice making cycle in which the incoming water is cooled, prior to the actual forming of ice. Also shown is the low-pressure refrigerant 71 flowing through the hollow portion 58 of the refrigerant passes 52. During this portion of the ice making cycle, the refrigerant is a cold, low-pressure mixture of liquid and vapor. Water 70 is cooled by the transfer of heat from the water 70 into the aluminum at the freezing sites 28, through the aluminum evaporator plate 50, and into the cold refrigerant 71.

FIG. 7 shows the evaporator assembly 26 after ice cubes 72 have formed over the freezing sites 28 and illustrates how the horizontal ridges 62 separate the ice cubes 72 vertically from one another. During this portion of the ice making cycle, cold low-pressure refrigerant 71 continues to flow through the refrigerant passes 52.

FIG. 8 shows the evaporator assembly during the harvest part of the ice making cycle. During this part of the cycle, hot high-pressure refrigerant gas is caused to flow through the refrigerant passes 52. This causes the entire evaporator assembly 26 to warm up and subsequently causes the layer of ice bonding the ice cubes 72 to the evaporator assembly 26 to melt. This releases the cubes 72, which then fall off the evaporator assembly into an ice bin located below. While no water is shown flowing in FIG. 8, water may or may not be allowed to flow over the evaporator assembly 26 surface during this part of the ice making cycle.

Figure 9:
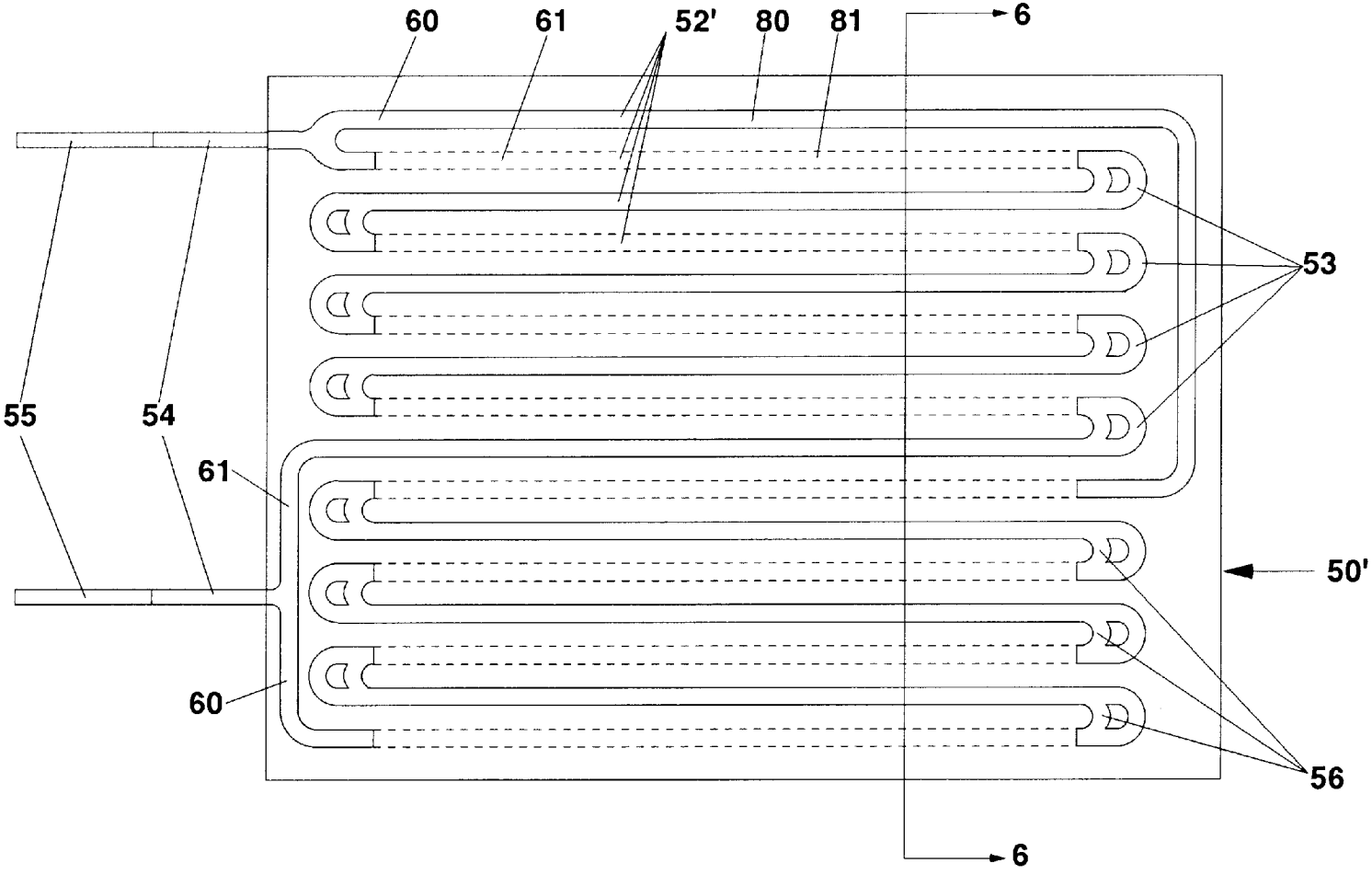
FIG. 9 is a plan view of an alternate embodiment of the aluminum roll-bond evaporator plate in which there are additional refrigerant passes, two refrigerant circuits redundant tube bends and the refrigerant passes are each flat on alternating sides of the plate.

FIG. 9 is a plan view of the preferred embodiment of evaporator plate 50' wherein each pass 52' is formed so that it is flat on one side (that is, flush with the flat aluminum plate 50' on one side). The side on which the pass 52' is flat alternates each pass. In FIG. 9, passes 52' shown with solid outlines are flat on the back side of the plate 50'. Passes 52' shown with dashed outlines are flat on the front side of the plate 50'. Thus the top pass 80 is flat on the back side, the next lower pass 81 is flat on the front side of the plate 50'. More detail on how these passes 52' are fabricated and their importance is provided herein below.

In 50' there are also sixteen passes 52' instead of twelve (as there are in plate 50 as shown in FIG. 2) and two refrigerant paths or circuits 60 and 61 instead of one. The manufacturing methods used to fabricate a roll-bond evaporator plate like 50' allows complete control over the number of refrigerant passes, circuits, tube locations, tube length, tube diameter, tube joints (for example, where two tubes merge into a single tube) and whether the tubes are kept flat on one side. Adding more tube length or passes can be done without adding cost to the evaporator—all that needs to be changed is the pattern of the weld-stop that is applied to the aluminum before the rolling/welding process.

When it is desirable to reduce the pressure drop of the refrigerant flowing through the evaporator plate 50, multiple refrigerant circuits can be used. Also, to reduce the pressure drop associated with the tube bends 53, it is possible to increase the tube diameter at the bends 53 and/or add redundant bends 56, as illustrated in FIG. 9. Each of these three methods (additional circuits, increased tube diameter and redundant bends) reduces pressure drop by providing additional cross-sectional flow area for the refrigerant, thereby lowering the velocity of the refrigerant and thus the associated pressure drop. Increasing the number of refrigerant circuits also shortens the path that the refrigerant must travel, thus further reducing pressure drop.

Figure 10:
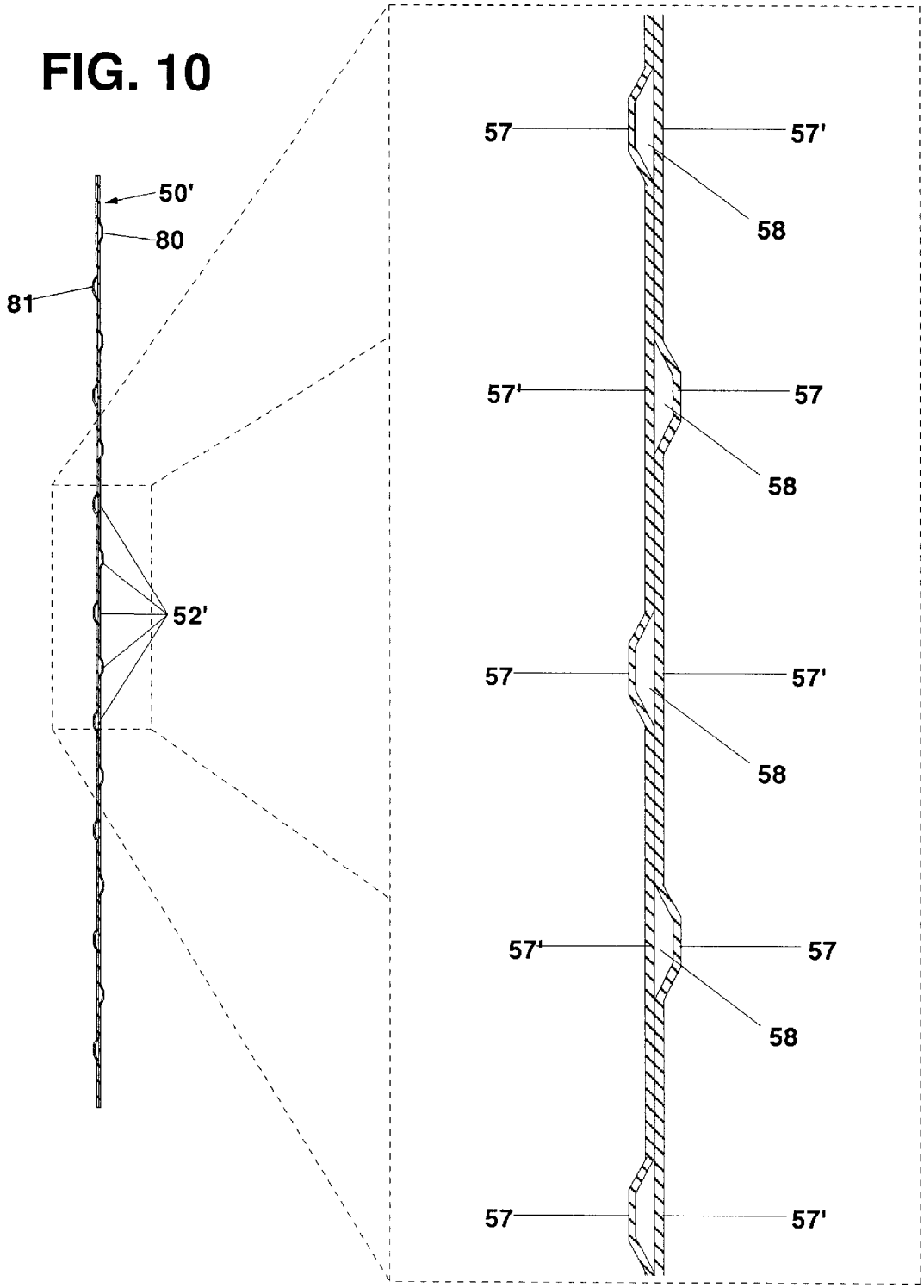
FIG. 10 is a cross-sectional view of the preferred embodiment of the aluminum roll-bond evaporator plate, taken along line 6—6 of FIG. 9, showing only those elements that are in the plane of the cross-section, in which the refrigerant passages are alternatingly flat on one side of the evaporator or the other.

FIG. 10 is a cross-sectional view of the preferred embodiment of the aluminum roll-bond evaporator plate 50' taken along line 6—6 of FIG. 9. FIG. 10 only shows the elements of evaporator plate 50' that are in the plane of the cross-section. Thus the U-shaped bend elements are not visible in FIG. 10. In this embodiment of evaporator plate 50', the refrigerant passes 52 are alternatingly flat on one side of the plate or the other. So, for example, the topmost refrigerant pass 80 has been inflated during manufacturing such that it protrudes only to the right (as shown in FIG. 10). The left side of pass 80 is flat and flush with the left side of the evaporator plate 50'. The next lower refrigerant pass 81 has been inflated such that it protrudes only to the left. The right side of pass 81 is flush with the right side of the evaporator plate 50'. On each subsequent refrigerant pass 52, one refrigerant pass wall 57 protrudes, while the opposing wall 57' is flat.

While it is common to manufacture aluminum roll-bond evaporators which have all the tubes flat and flush on one side of the plate, there have not been plates made as it is shown in FIG. 10 where the tubes are alternatingly flat on one side and then the other. Manufacturing of roll-bond evaporator plates wherein all the tubes are flat on the same side of the plate is accomplished by fixturing the evaporator so that the tubes are only allowed to expand on one side of the plate when they are inflated. Likewise, it is a relatively simple matter to design a fixture so that every other tube expands to the opposite side as shown in FIG. 10.

Figure 11:
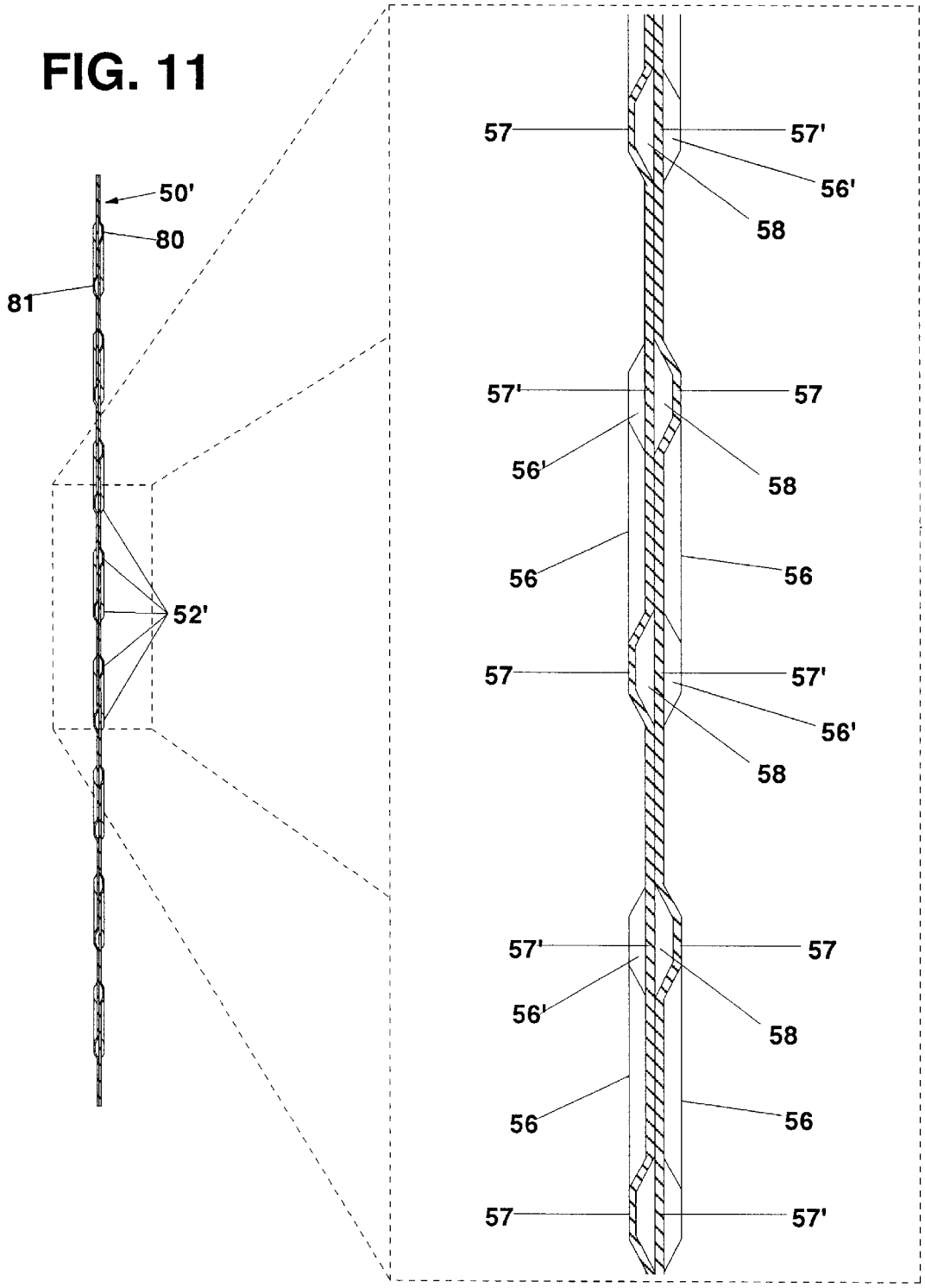
FIG. 11 is a cross-sectional view of the preferred embodiment of the aluminum roll-bond evaporator plate, taken along line 6—6 of FIG. 9, in which the refrigerant passages are alternatingly flat on one side of the evaporator or the other.

FIG. 11 is also a cross-sectional view of the preferred embodiment of the aluminum roll-bond evaporator plate 50' taken along line 6—6 of FIG. 9. FIG. 11, however, does show the elements of evaporator plate 50' that exist beyond the plane of the cross-section. Thus the U-shaped bend elements are visible in FIG. 11. FIG. 11 shows that on evaporator plate 50', the U-shaped bend areas 53 and 56 are allowed to expand to (or protrude on) both sides of the plate 50' so as to provide the transition from flat tube on one side (e.g., the left side) to flat tube on the other side (e.g., the right side) between passes 52'. U-shaped bend areas 56' shows the outside surface of of the U-shaped bend as it transitions from protruding on both sides to being flat on one side.

Figure 12:
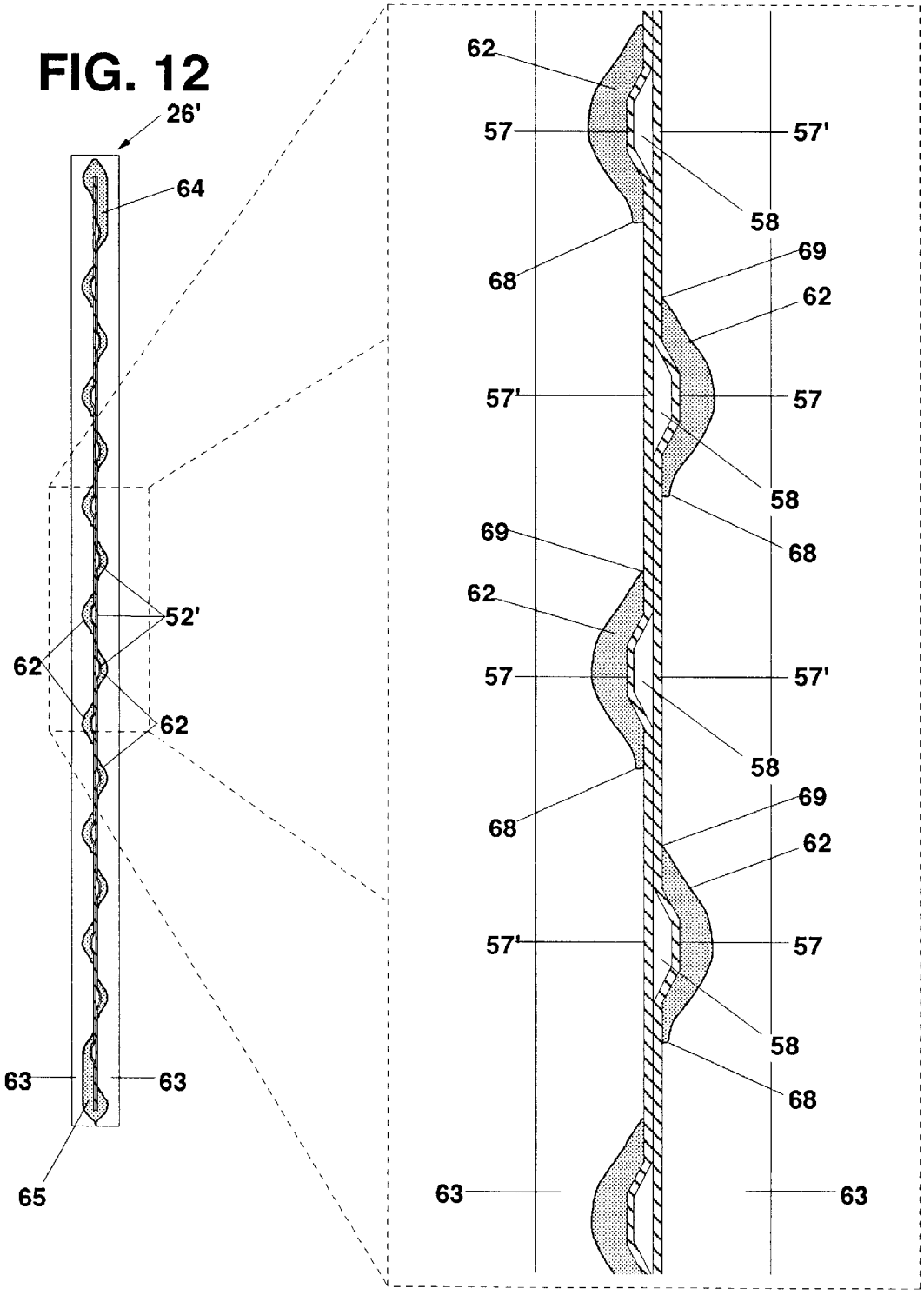
FIG. 12 is a cross-sectional view of the preferred embodiment of the evaporator assembly, taken along line 3—3 of FIG. 1, in which the refrigerant passages are alternatingly flat on one side of the evaporator or the other.

FIG. 12 is a cross-sectional view of the preferred embodiment of the aluminum roll-bond evaporator assembly 26' taken along line 3—3 of FIG. 1. This preferred embodiment incorporates the preferred evaporator plate 50' which is shown in FIGS. 9–11. Like evaporator assembly 26 shown in FIGS. 4 through 8, there are horizontal plastic ridges 62' injection molded onto either side of the evaporator plate 50'. As before, these ridges 62' are molded on top of and straddle the raised or protuding walls 57 of the refrigerant passes 52'. However, each refrigerant pass 52' has a ridge 62' on only the non-flat or protuding wall 57 side—there are no ridges 62' molded over the flat walls 57' of the refrigerant pass 52'. Thus the freezing sites 28' on one side of the evaporator assembly 26' are now offset or staggered from the freezing sites 28' on the other side of the evaporator assembly 26'.

It was stated previously that it would be desirable to leave the walls of the refrigerant passes 52 free of plastic to improve heat transfer. It was also stated that this would not be practical since the manufacturing tolerances associated with the refrigerant passes 52 are too large to allow the injection molding die to precisely conform to the refrigerant passes 52 (more precisely, to the protruding pass walls 57), such that those areas could be kept free of plastic. However, with the refrigerant pass walls 57' being flat, the manufacturing tolerances of the refrigerant passes 52 is no longer an issue. As long as the flat wall 57' of the refrigerant passes 52' is reasonably flat, a flat face in the injection molding die will conform to it.

There are several significant benefits resulting from this preferred configuration of the evaporator assembly 26' (as shown in FIG. 12) relative to evaporator assembly 26 (shown in FIGS. 4–8). First, because a portion of the freezing site 28' is now directly adjacent to the refrigerant pass 52', that portion will benefit from having direct heat transfer from the water/ice through the refrigerant passage wall 57' into the refrigerant. This is in contrast to the freezing site 28 of evaporator assembly 26 wherein the heat must travel a much longer distance through the aluminum to get to the refrigerant.

Second, using the configuration as shown in FIG. 12 it is possible to increase the length of the freezing sites 28' (relative to freezing sites 28 in evaporator assembly 26) while decreasing the distance between adjacent refrigerant passes 52'. This results in a more efficient utilization of the evaporator assembly 26' surface. For example, in both evaporator assembly 26 and 26', the distance between the top and bottom refrigerant passage 51 is the same. Yet in evaporator assembly 26, there are twenty horizontal ridges 62—that is, twenty areas of reduced heat transfer. In evaporator assembly 26', there are only fourteen horizontal ridges 62'—i.e., only fourteen areas of reduced heat transfer. This results in evaporator assembly 26' having forty-six percent more freezing site area (in this example) than evaporator assembly 26. This is despite the fact that there are only sixteen freezing sites instead of twenty-two.

Third, it can be seen that since the refrigerant passes 52' are now closer together, the distance heat must travel through the aluminum to get to the refrigerant is always less. Thus heat transfer at any point on evaporator assembly 26' is superior to that of evaporator assembly 26.

It is important to note how these changes can be utilized to reduce the cost of the evaporator. First, decreasing the distance between refrigerant passes 52' (i.e., adding refrigerant passes) can be accomplished on a roll-bond type evaporator without an increase in cost. Second, decreasing the distance between refrigerant passes makes it is possible to use a thinner and/or less conductive material without losing heat transfer efficiency—thus material (and cost) could be removed or a less expensive material could be used. Third, an increase in freezing area (as described above) can be translated directly to a reduction in evaporator cost; that is, if the evaporator design provides more freezing area per evaporator, then an equivalent amount of heat can be transferred with either less total evaporator area or a smaller number of evaporators.

Conversely, rather than reducing cost, the higher performance evaporator assemblies 26' could be used instead to boost the overall performance (ice producing capacity and energy efficiency) of the ice machine.

Figure 13:
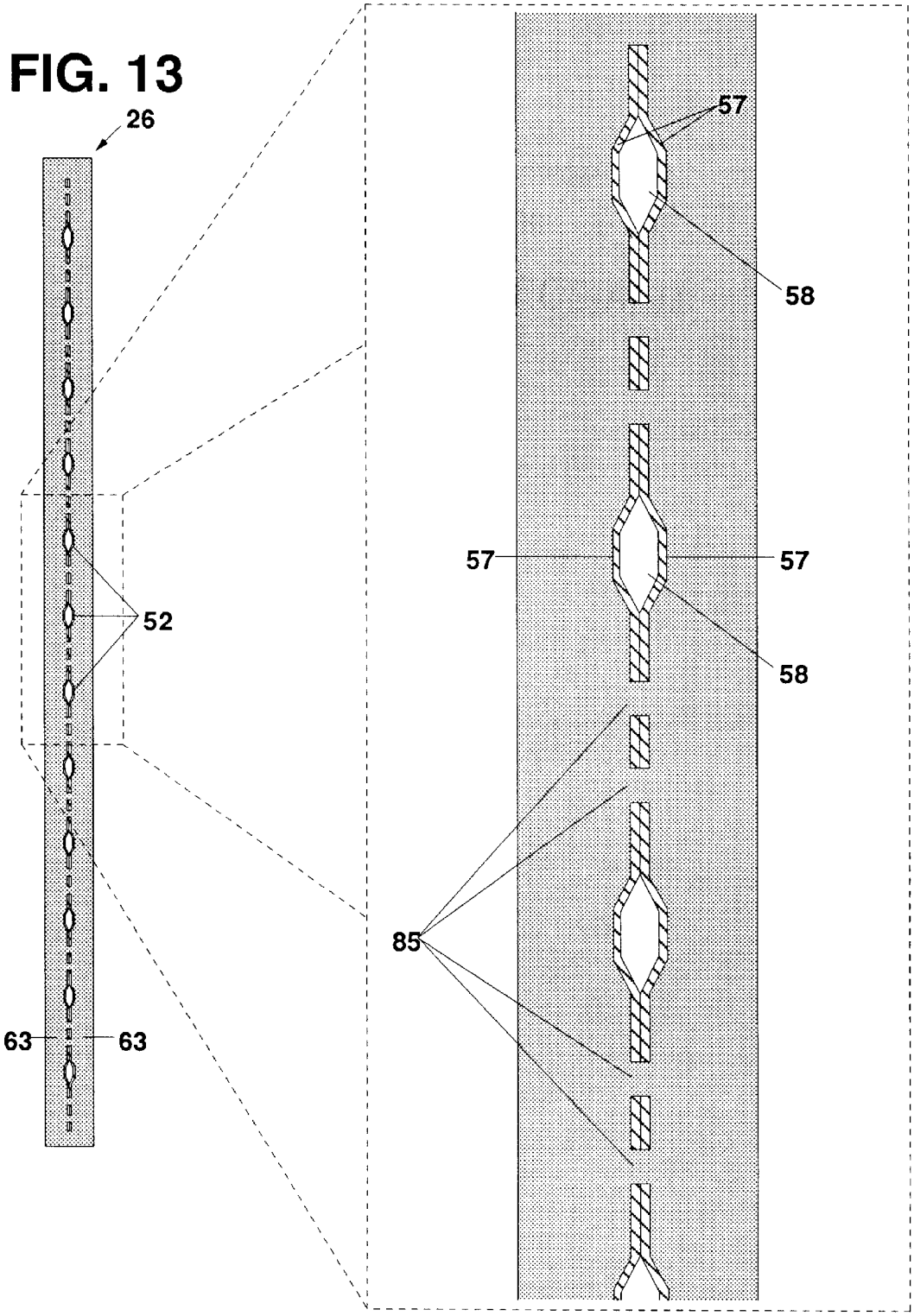
FIG. 13 is a cross-sectional view of one embodiment of the evaporator assembly, taken along line 4—4 of FIG. 1.

FIG. 13 is a cross-sectional view of evaporator assembly 26 taken along line 4—4 of FIG. 1, through one of the vertical ridges 63. FIG. 13 illustrates one possible way to cause the plastic grid 59 to adhere to both sides of the evaporator plate 50 or 50'. Placing holes 85 through the evaporator plate 50, prior to injection molding, allows the plastic on either side to flow through the holes and form a portion of grid material which extends through the holes 85 and links the plastic on one side of the evaporator plate 50 with the plastic on the other side. Given a sufficient number of holes 85 through the evaporator plate, enough links will be formed to adequately hold all the plastic to the evaporator plate 50 or 50'.

It is important when placing holes through the evaporator plate that these holes be placed in the same plane as the vertical ridges 63. If the holes 85 are placed too close to the refrigerant passes 52, it can weaken the welds on either side of passes 52 and introduce the possibility of a tube rupture. However, if the holes are placed in-line with the vertical ridges 63, the holes can be spaced sufficiently far from the tube passes 52 and still be in a region of plastic needed to form the links between sides.

Figure 14:
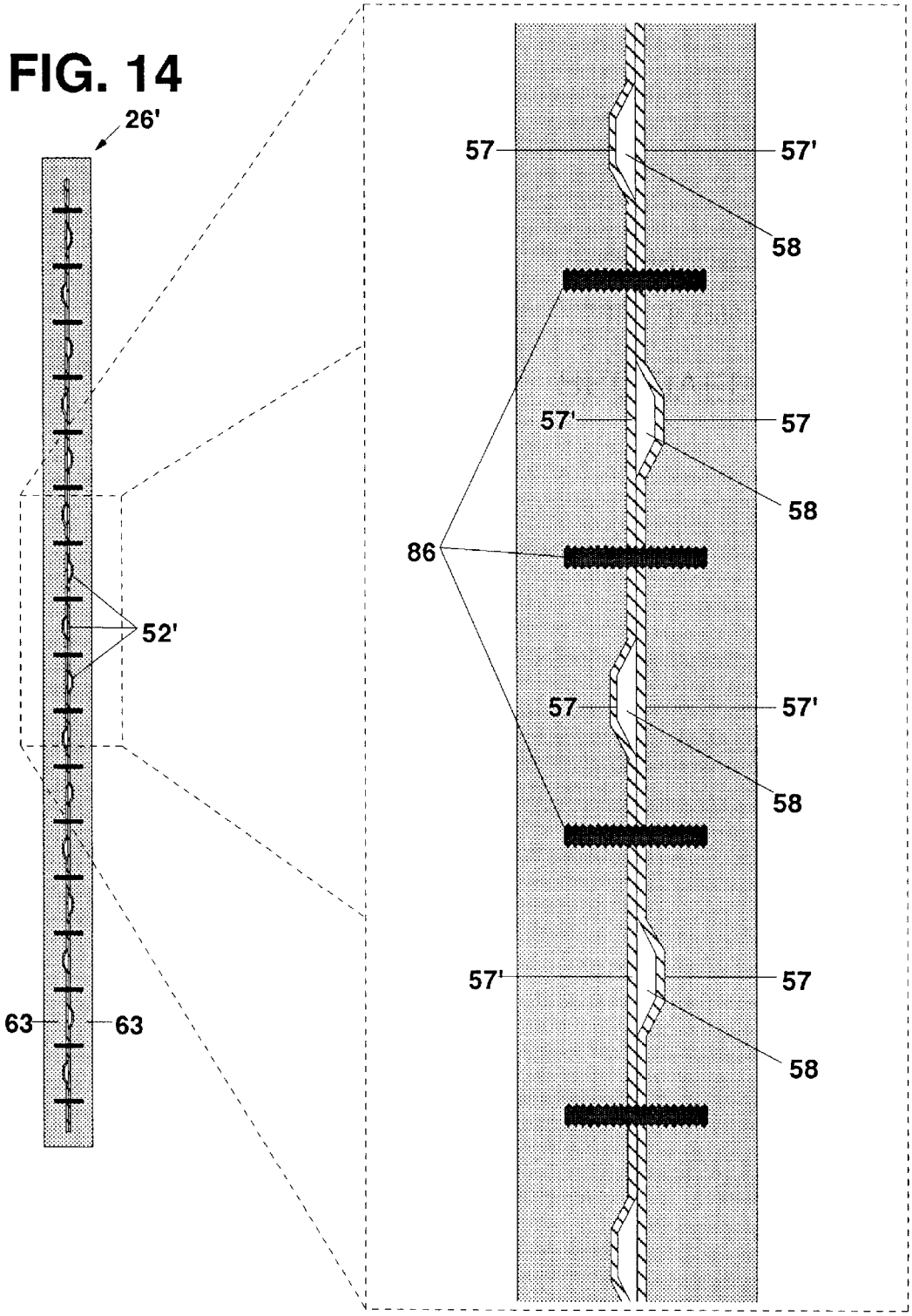
FIG. 14 is a cross-sectional view of the preferred embodiment of the evaporator assembly, taken along line 4—4 of FIG. 1.

FIG. 14 is a cross-sectional view of the preferred embodiment of the evaporator assembly 26', taken along line 4—4 of FIG. 1, through one of the vertical ridges 63. FIG. 14 shows heat conductive (e.g., metal) anchors 86 inserted through the evaporator plate 50' to anchor the plastic grid 59 onto either side of the evaporator plate 50'. The anchors 86 can be used instead of the holes 85 as shown in FIG. 13. The anchors 86 have several advantages over the holes 85 shown in FIG. 13: 1.) The anchors 86 will provide added rigidity to the vertical ridges 63. 2.) The anchors 86 provide a more reliable bond between the plastic grid 59 and the evaporator plate 50'. 3.) As long as the anchors are made of a suitably conductive material, the anchors 86 will provide an improved thermal path for heat to travel between the evaporator 50' and the vertical ridges 63. This improved thermal path can be significant, since (as shown in FIG. 14) it would occur in the area most distant from the refrigerant pass 52.

It should be clear that either of the two anchoring means (holes 85 or anchors 86) could be utilized with either of the two evaporator plate configurations 50 or 50' described herein.

What I claim is:

1. Apparatus for making ice comprising:

a refrigeration system including at least one evaporator assembly;

a water supply means for supplying water to the exterior surface of said evaporator assembly;

said evaporator assembly having a roll-bond metal plate with one or more integral serpentine refrigeration passages therethrough and having a grid of material molded onto said plate, said grid having ridges defining an array of discrete freezing sites on said plate such that the water flowing over said freezing sites will form individual ice cubes at said freezing sites.

2. The apparatus of claim 1 wherein said plate is constructed from aluminum.

3. The apparatus of claim 1 wherein said plate is constructed from an aluminum alloy.

4. The apparatus of claim 1 wherein said plate is constructed from copper.

5. The apparatus of claim 1 wherein said grid is held onto said plate by conductive anchors which extend out on either side of said plate and are molded into said grid material.

6. The apparatus of claim 1 wherein said grid is held onto said plate by portions of said grid material which extend through holes placed through said plate.

7. The apparatus of claim 1 wherein bumps or other surface irregularities with a dimension in the direction of the flow of said water of between 1/16 and 1/8 of an inch are molded into said grid material above one or more of said freezing sites to interrupt the fluid boundary layer formation in said water flowing over said bumps and thereby increase the heat transfer between said water and said freezing sites.

8. The apparatus of claim 1 wherein said refrigeration passages consist of one or more straight refrigeration passes connected by U-shaped bends and wherein said ridges protrude out from said plate and are parallel with at least one of said straight refrigeration passes.

9. The apparatus of claim 8 wherein said parallel ridges straddle one or more of said straight refrigeration passes.

10. The apparatus of claim 1 wherein said refrigeration passages consist of one or more horizontally oriented straight refrigeration passes connected by U-shaped bends and wherein said ridges protrude out from said plate and are parallel with at least one of said horizontal straight refrigeration passes.

11. The apparatus of claim 10 wherein said parallel ridges straddle one or more of said horizontal refrigeration passes.

12. The apparatus of claim 1 wherein said refrigeration passages consist of one or more straight refrigeration passes connected by U-shaped bends wherein one or more of said straight passes are constructed so that said straight pass is substantially flat and flush with one side of said plate.

13. The apparatus of claim 12 wherein at least one of said ridges is parallel with and straddles the non-flat side of at least one of said flat straight passes.

14. The apparatus of claim 12 wherein at least one of said flat straight passes on said plate is arranged to be flat on the opposite side of said plate as at least one other said flat straight pass on said plate.

15. The apparatus of claim 14 wherein at least one of said ridges is parallel with and straddles the non-flat side of at least one of said flat straight passes.

16. The apparatus of claim 12 wherein each of said flat straight passes is is arranged to be flat on the opposite side of said plate as each adjacent flat straight pass.

17. The apparatus of claim 16 wherein at least one of said ridges is parallel with and straddles the non-flat side of at least one of said flat straight passes.

18. The apparatus of claim 16 wherein said U-shaped bends at the end of each flat straight pass is constructed to protude on both sides so that said bends can connect said adjacent flat passes which are flat on opposite sides of said plate.

19. The apparatus of claim 1 wherein said refrigeration passage has mulitple refrigerant paths or circuits.

20. The apparatus of claim 1 wherein said refrigeration passages consist of one or more straight refrigeration passes connected by U-shaped bends and wherein at least two adjacent straight passes are connected by two or more U-shaped bends.

21. Apparatus for making ice comprising:

a refrigeration system including at least one evaporator assembly;

a water supply means for supplying water to the exterior surface of said evaporator assembly;

said evaporator assembly having a metal plate with one or more integral serpentine refrigeration passages therethrough and having a grid of material molded onto said plate, said grid having ridges defining an array of discrete freezing sites on said plate such that the water flowing over said freezing sites will form individual ice cubes at said freezing sites.

22. The apparatus of claim 21 wherein said plate is constructed from aluminum.

23. The apparatus of claim 21 wherein said plate is constructed from an aluminum alloy.

24. The apparatus of claim 21 wherein said plate is constructed from copper.

25. The apparatus of claim 21 wherein said grid is held onto said plate by conductive anchors which extend out on either side of said plate and are molded into said grid material.

26. The apparatus of claim 21 wherein bumps or other surface irregularities with a dimension in the direction of the flow of said water of between 1/16 and 1/8 of an inch are molded into said grid material above one or more of said freezing sites to interrupt the fluid boundary layer formation in said water flowing over said bumps and thereby increase the heat transfer between said water and said freezing sites.

27. The apparatus of claim 21 wherein said refrigeration passages consist of one or more straight refrigeration passes connected by U-shaped bends and wherein said ridges protrude out from said plate and are parallel with at least one of said straight refrigeration passes.

28. The apparatus of claim 27 wherein said parallel ridges straddle one or more of said straight refrigeration passes.

29. The apparatus of claim 21 wherein said refrigeration passages consist of one or more horizontally oriented straight refrigeration passes connected by U-shaped bends and wherein said ridges protrude out from said plate and are parallel with at least one of said horizontal straight refrigeration passes.

30. The apparatus of claim 29 wherein said parallel ridges straddle one or more of said horizontal refrigeration passes.

31. The apparatus of claim 21 wherein said refrigeration passages consist of one or more straight refrigeration passes connected by U-shaped bends wherein one or more of said straight passes are constructed so that said straight pass is substantially flat and flush with one side of said plate.

32. The apparatus of claim 31 wherein at least one of said ridges is parallel with and straddles the non-flat side of at least one of said flat straight passes.

33. The apparatus of claim 21 wherein at least one of said flat straight passes on said plate is arranged to be flat on the opposite side of said plate as at least one other said flat straight pass on said plate.

34. The apparatus of claim 33 wherein at least one of said ridges is parallel with and straddles the non-flat side of at least one of said flat straight passes.

35. The apparatus of claim 21 wherein each of said flat straight passes is is arranged to be flat on the opposite side of said plate as each adjacent flat straight pass.

36. The apparatus of claim 35 wherein at least one of said ridges is parallel with and straddles the non-flat side of at least one of said flat straight passes.

37. The apparatus of claim 35 wherein said U-shaped bends at the end of each flat straight pass is constructed to protude on both sides so that said bends can connect said adjacent flat passes which are flat on opposite sides of said plate.

38. The apparatus of claim 21 wherein said refrigeration passage has mulitple refrigerant paths or circuits.

39. The apparatus of claim 21 wherein said refrigeration passages consist of one or more straight refrigeration passes connected by U-shaped bends and wherein at least two adjacent straight passes are connected by two or more U-shaped bends.

40. Apparatus for making ice comprising:

a refrigeration system including at least one evaporator assembly;

a water supply means for supplying water to the exterior surface of said evaporator assembly;

said evaporator assembly having a metal plate with one or more serpentine refrigeration passages and having a grid of material molded onto said plate, said grid having ridges defining an array of discrete freezing sites on said plate such that the water flowing over said freezing sites will form individual ice cubes at said freezing sites.

41. The apparatus of claim 40 wherein said plate is constructed from aluminum.

42. The apparatus of claim 40 wherein said plate is constructed from an aluminum alloy.

43. The apparatus of claim 40 wherein said plate is constructed from copper.

44. The apparatus of claim 40 wherein said grid is held onto said plate by conductive anchors which extend out on either side of said plate and are molded into said grid material.

45. The apparatus of claim 40 wherein bumps or other surface irregularities with a dimension in the direction of the flow of said water of between 1/16 and 1/8 of an inch are molded into said grid material above one or more of said freezing sites to interrupt the fluid boundary layer formation in said water flowing over said bumps and thereby increase the heat transfer between said water and said freezing sites.

46. The apparatus of claim 40 wherein said refrigeration passages consist of one or more straight refrigeration passes connected by U-shaped bends wherein one or more of said straight passes are constructed so that said straight pass protude on only one side of said plate and said straight pass is flat on the other side of said plate.

47. The apparatus of claim 46 wherein at least one of said ridges is parallel with and straddles the protruding side of at least one of said straight passes.

48. The apparatus of claim 46 wherein at least one of said protruding straight passes on said plate is arranged to protrude on the opposite side of said plate as at least one other said protruding straight pass on said plate.

49. The apparatus of claim 48 wherein at least one of said ridges is parallel with and straddles the protruding side of at least one of said protruding straight passes.

50. The apparatus of claim 46 wherein each of said protruding straight passes is is arranged to be protruding on the opposite side of said plate as each adjacent protruding straight pass.

51. The apparatus of claim 50 wherein at least one of said ridges is parallel with and straddles at least one of said protruding straight passes.

52. The apparatus of claim 40 wherein said refrigeration passage has mulitple refrigerant paths or circuits.

* * * * *